US011466959B2

(12) United States Patent
White et al.

(10) Patent No.: US 11,466,959 B2
(45) Date of Patent: Oct. 11, 2022

(54) HANDGUN AND METHOD OF USING A HANDGUN

(71) Applicant: Shield Corporation Limited, Bournemouth (GB)

(72) Inventors: James White, Bournemouth (GB); Jeremy White, Bournemouth (GB); Mathew Courtice, Bournemouth (GB)

(73) Assignee: Shield Corporation Limited, Boumemouth (GB)

( * ) Notice: Subject to any disclaimer, the term of this patent is extended or adjusted under 35 U.S.C. 154(b) by 0 days.

(21) Appl. No.: 17/148,458

(22) Filed: Jan. 13, 2021

(65) Prior Publication Data

US 2021/0215457 A1 Jul. 15, 2021

(30) Foreign Application Priority Data

Jan. 15, 2020 (GB) ..... 2000621

(51) Int. Cl.
*F41G 1/30* (2006.01)
*F41G 1/14* (2006.01)
*F41C 3/00* (2006.01)

(52) U.S. Cl.
CPC ..... *F41G 1/30* (2013.01); *F41G 1/14* (2013.01); *F41C 3/00* (2013.01)

(58) Field of Classification Search
CPC ..... F41G 1/30; F41G 1/14; F41C 3/00
USPC ..... 42/113
See application file for complete search history.

(56) References Cited

U.S. PATENT DOCUMENTS

| | | | | |
|---|---|---|---|---|
| 9,453,706 | B1 * | 9/2016 | Crispin | F41G 1/26 |
| 9,696,114 | B1 | 7/2017 | Cabrera et al. | |
| 2018/0195835 | A1 * | 7/2018 | Crispin | F41G 1/30 |
| 2019/0257620 | A1 | 8/2019 | Zimmer | |
| 2021/0215457 | A1 * | 7/2021 | White | F41G 1/30 |

FOREIGN PATENT DOCUMENTS

GB 2573812 A 11/2019

OTHER PUBLICATIONS

Search Report for United Kingdom Patent Application No. GB2000621.9, dated Jul. 3, 2020, 4 pages.

* cited by examiner

*Primary Examiner* — Samir Abdosh
(74) *Attorney, Agent, or Firm* — Dinsmore & Shohl, LLP

(57) ABSTRACT

There is provided a handgun for aiming at a target. The handgun comprises a handgun body, a slide arranged to move with respect to the handgun body, a lens removably mounted on the slide, and a light source associated with the slide and positioned at the focal point of the lens, such that when a user aims the handgun at the target, light from the light source reflects from the lens to the user's eye, providing an infinity image of an illuminated dot over the target. The lens is removable from both of the slide and the light source.

14 Claims, 12 Drawing Sheets

HANDGUN AND METHOD OF USING A HANDGUN

CROSS-REFERENCE TO RELATED APPLICATIONS

This application claims priority to United Kingdom (GB) Application No. 2000621.9, filed Jan. 15, 2020, the entire contents of which are incorporated herein by reference.

INTRODUCTION

Field

The present invention concerns handguns. More particularly, but not exclusively, this invention concerns handguns incorporating reflector sights. The invention also concerns a method of using a handgun.

Background

Popular sights for firearms include reflector sights, which provide an infinity image of a reticle over a field of view. The reticle remains in alignment with the firearm and does not move as the user's eye moves. When a red LED is placed at the focal point of the reflector lens, a red-dot reticle is generated, which provides an aimpoint for the firearm. Red-dot sights are used in a variety of applications, including on rifles, and on smaller firearms such as handguns.

Currently available red-dot sights for handguns tend to be mounted via a mounting plate which is machined into the slide during manufacture. A handgun is typically provided with a mounting plate that can accept a variety of different sights, depending on the preference of the user. The sight can be removed and replaced if damaged. An example of a red-dot sight is the Shield™ RMS™ reflex mini sight. It includes optical components protected within an aluminum housing. The sight is mounted on the handgun using a mounting plate.

To improve accuracy of shooting, it would be desirable to lower the line of sight with respect to the bore axis. To date, developments in sights have tended to focus on reducing the size of the sight that is fitted to the mounting plate. A new reflector sight and/or handgun is required.

SUMMARY

In a first aspect of the invention there is provided a handgun for aiming at a target, the handgun comprising: a handgun body; a slide arranged to move with respect to the handgun body; a lens removably mounted on the slide; and a light source associated with the slide and positioned at the focal point of the lens, such that when a user aims the handgun at the target, light from the light source reflects from the lens to the user's eye, providing an infinity image of an illuminated reticle over the target; wherein the lens is removable from both of the slide and the light source.

In an advantage over handguns of the prior art which have sights fixed to a mounting plate on the slide, the present invention may provide a sight line lower to the bore axis of the handgun because there is no need for such a mounting plate. The optical components are closer to the bore of the handgun, which provides an illuminated reticle which is more representative of the actual aim of the handgun. Thus accuracy of shooting is improved. In a further advantage, the handgun of the present invention can be manufactured through small adaptations to the existing tools and process (avoiding machining into the slide).

The handgun may comprise a red-dot generator. The red-dot generator may comprise the light source. The light source may be an LED. There is preferably no mounting plate between the red-dot generator and/or the light source and the slide. The handgun of the present invention may provide an advantage over conventional handguns, in providing a sight which is less likely to become loose (unlike sights which are mounted using screws and a mounting plate). Furthermore, since the sight of the present invention is integrated with the slide (i.e. it does not require a separate mounting plate), the number of components required for assembly is minimized. Alternatively or additionally, if the lens becomes damaged or if the user requires a different size or shape of lens, the handgun of the present invention may enable the lens itself to be removed and replaced, whilst leaving the light source and other components in place.

The handgun may comprise a reflector associated with the slide, wherein the light source is positioned at the focal point of the reflector; and wherein the reflector is arranged to provide a continuous reflecting surface with the lens; such that when the user aims the handgun at the target, light from the light source reflects from the reflector and the lens to the user's eye, providing the infinity image of the illuminated reticle over the target.

Such a reflector may provide a back-up in case the lens becomes defective, for example if it is dropped and broken, or scratched. The light source will remain at the focal point of the reflector, and hence an infinity image of an illuminated reticle will still be visible, albeit the user may have to more accurately align with the slide in order to see the illuminated reticle, compared to the wider viewing window enabled by the presence of the lens. Thus the handgun remains useable, even if the lens is damaged. The inventors have recognized that inclusion of such a back-up reflector may mean that the traditional iron sights, conventionally used as a back-up for a reflector sight, might not be required and may therefore be removed from the slide, providing a clearer view of the target.

The reflector may be integrally formed with the slide. Such a feature may enable easier manufacturing or assembly and/or may ensure a more precise alignment between the reflector and the light source. Such a feature may be especially useful if the reflector is used to guide the lens into position on the slide.

The reflector may comprise metal. A reflector made of metal may provide a durable, shatter-resistant reflector which can be relied upon to work even if the handgun is dropped and the lens damaged.

The lens may surround the top and sides of the reflector, to provide a protective bumper. Such a feature may enable the lens to continue to provide protection to the reflector even in the event that the lens is broken.

The height of the reflector may be less than half the height of the lens. The maximum width of the reflector may be less than half the maximum width of the lens. The reflector may provide 20% or less, preferably approximately 10% of the total reflecting area comprising the lens plus reflector. The reflector may be small compared to the lens, so that it does not obstruct the view through the lens in normal operation.

The slide may comprise one or more lugs arranged to cooperate with one or more recesses in the slide to hold the lens in place. Such a feature may enable the lens to be quickly and easily removed and replaced, whilst ensuring high accuracy of placement which is important for ensuring the light source remains at the focal point of the lens.

The lens may comprise a clear polymer. The lens may be formed entirely of a clear polymer. Use of a clear polymer optic may provide a more shatter-resistant lens than say, a traditional glass optic. The lens may be un-coated, for example having no color-selective filter.

The lens may be frameless. Use of such a lens may reduce the volume of materials required for manufacture of the handgun, and furthermore, may enable a clearer view of the field, unobstructed by the frame.

There may be an unobstructed view along the slide upper surface to the lens. In some embodiments, there may be no iron sights on the slide. In some embodiments, the view may be unobstructed because traditional iron sights are not present. An unobstructed view may enable the illuminated reticle to be located more quickly, improving usability.

The light source may be a red LED, and the illuminated reticle may be an illuminated dot, such as a red-dot. A red-dot may enable ease of locating the aiming position.

The elevation of the light source may be adjustable relative to the slide. The light source may be situated inside a housing mounted for movement relative to the slide.

For example, the light source may be situated inside a cylindrical housing mounted for rotational movement and lateral movement on the slide. The rotational movement may be about the longitudinal axis of the cylindrical housing. Such a feature may enable the position of the illuminated reticle to be adjusted to take into account the handgun's aim.

Alternatively, the light source may be associated with a carrier in an adjustment assembly, wherein the carrier has two channels receiving two barrel nuts, the channels oriented perpendicularly to one another. Such an arrangement is described in UK Patent Publication No. GB2573821A.

The handgun may further comprise a battery removably mounted on the slide. The battery may be removable from the top of the slide, or from either side of the slide.

In a second aspect of the invention there is provided a method of using the handgun of any preceding claim, including the steps of: removing the lens from the slide; replacing the lens with a different lens.

In a third aspect of the invention there is provided a kit of parts for forming a handgun, the kit comprising: a plurality of lenses; a handgun body; a slide arranged to move with respect to the handgun body, the slide configured to receive a lens selected from the plurality of lenses; a LED attached to the slide and positioned at the focal point of the lens when the lens is received in the slide, such that when the lens is received in the slide and the handgun is aimed at a target, light from the LED reflects from the lens to the user's eye, providing an infinity image of an illuminated reticle over the target; and such that when the lens is received in the slide, the lens is removable from both of the slide and the LED.

In a fourth aspect of the invention there is provided a handgun for aiming at a target, the handgun comprising: a handgun body; a slide arranged to move with respect to the handgun body; a lens removably mounted on the slide; a reflector protruding from the slide and surrounded by the lens, wherein the reflector is arranged to provide a continuous reflecting surface with the lens; a red-dot generator integrated into the slide, the red-dot generator comprising a light source positioned at the common focal point of the lens and the reflector, such that when a user aims the handgun at the target, light from the light source of the red-dot generator reflects from the lens and the reflector to the user's eye, providing an infinity image of an illuminated dot over the target; wherein the lens is removable from the slide such that it can be replaced without removal of the reflector and/or the red-dot generator.

In a fifth aspect of the invention there is provided a handgun for aiming at a target, the handgun comprising: a handgun body; a slide arranged to move with respect to the handgun body; a reflector formed with and protruding from the slide; a red-dot generator integrated into the slide, the red-dot generator comprising a light source positioned at the focal point of the reflector, such that when a user aims the handgun at the target, light from the light source of the red-dot generator reflects from the reflector to the user's eye, providing an infinity image of an illuminated reticle over the target.

It will of course be appreciated that features described in relation to one aspect of the present invention may be incorporated into other aspects of the present invention. For example, the method of the invention may incorporate any of the features described with reference to the apparatus of the invention and vice versa.

DESCRIPTION OF THE DRAWINGS

Embodiments of the present invention will now be described by way of example only with reference to the accompanying schematic drawings of which.

DETAILED DESCRIPTION

Figure 1:
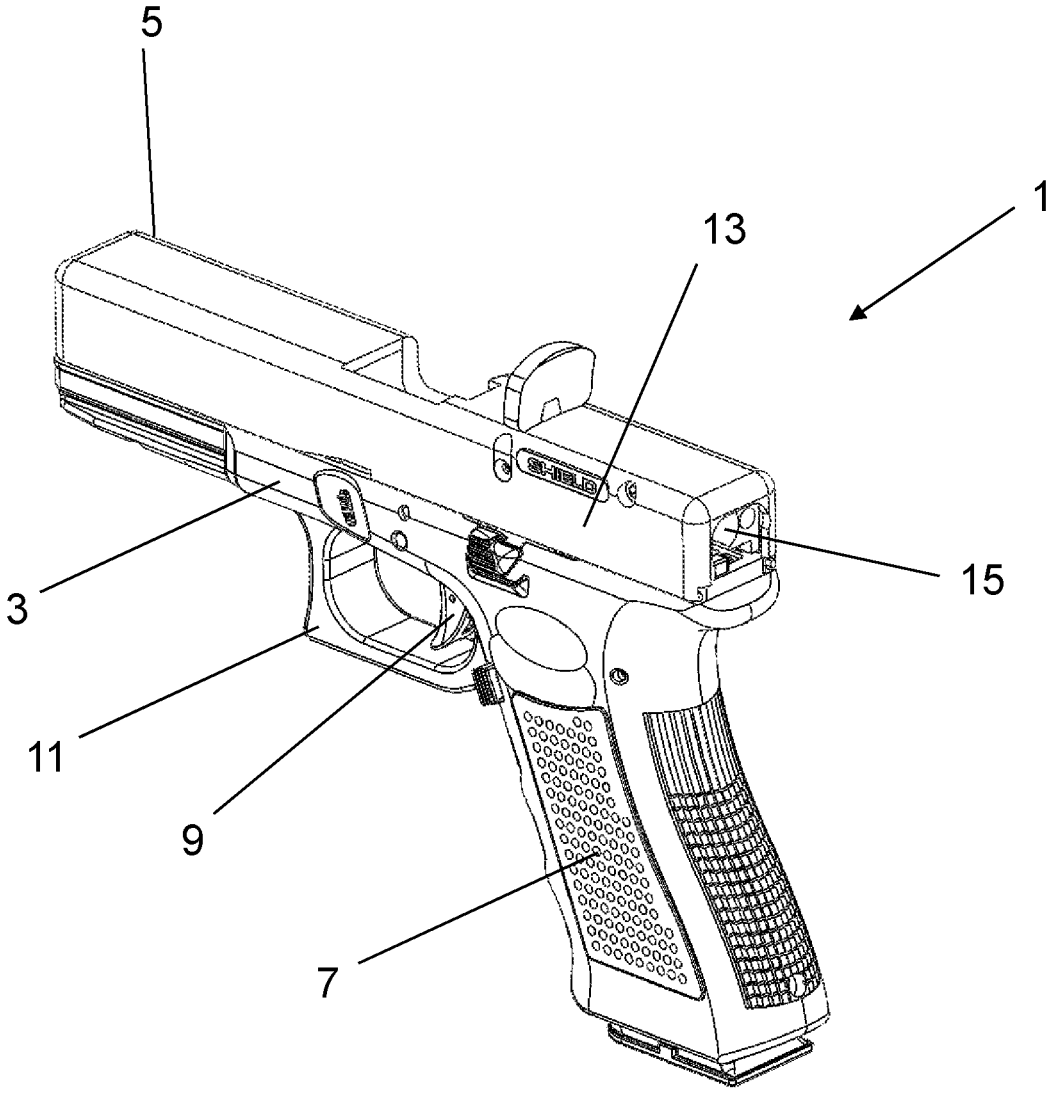
FIG. 1 is a perspective view of a handgun according to a first example embodiment of the invention.

In the first example embodiment of the invention, a handgun 1 includes a handgun body 3, and a spring-actuated slide 5 mounted for linear movement across the top of the handgun body 3 (FIG. 1). As is conventional, the handgun body 3 includes a grip 7, a trigger 9 for releasing ammunition and trigger guard 11, and a barrel 13 defining an inner bore 15 through which ammunition is fired.

Figure 2:
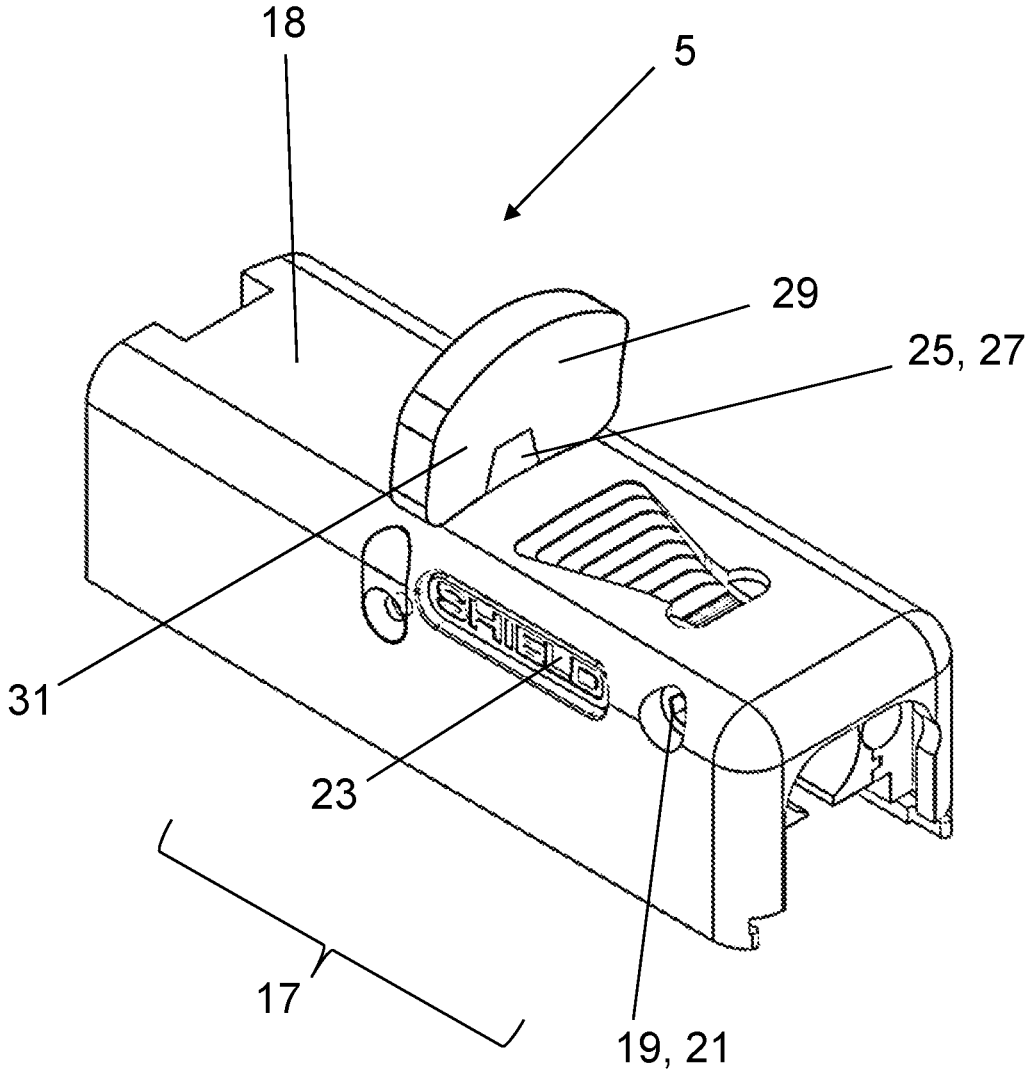
FIG. 2 is a perspective view of the slide of the handgun of FIG. 1.
Figure 3:
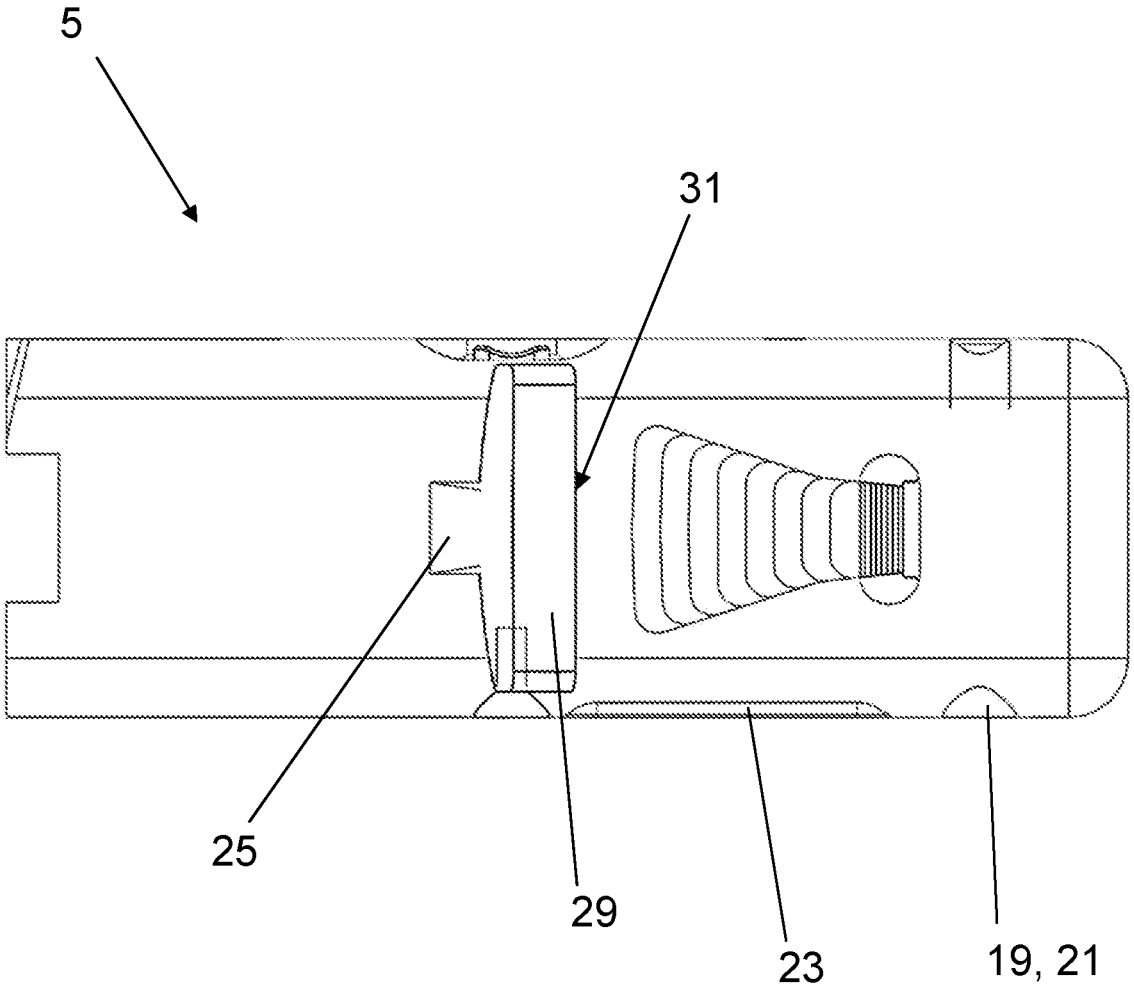
FIG. 3 is a top view of the slide of FIG. 2.
Figure 4:
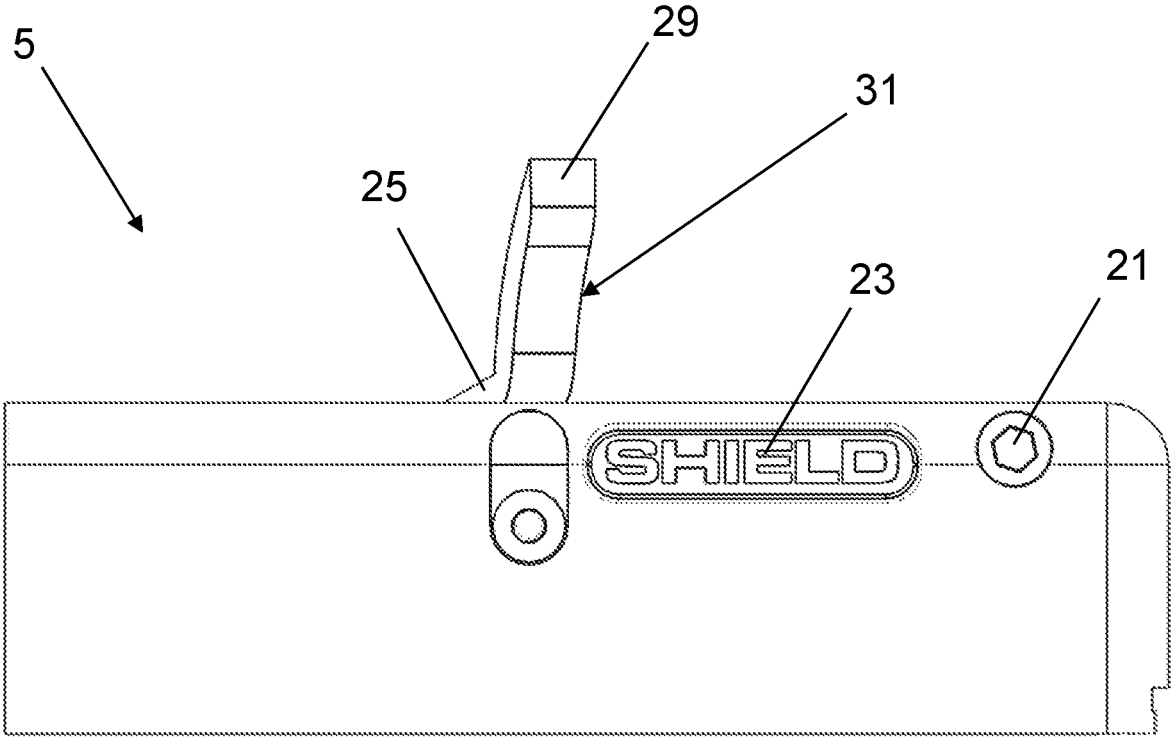
FIG. 4 is a side view of the slide of FIG. 2.
Figure 5:
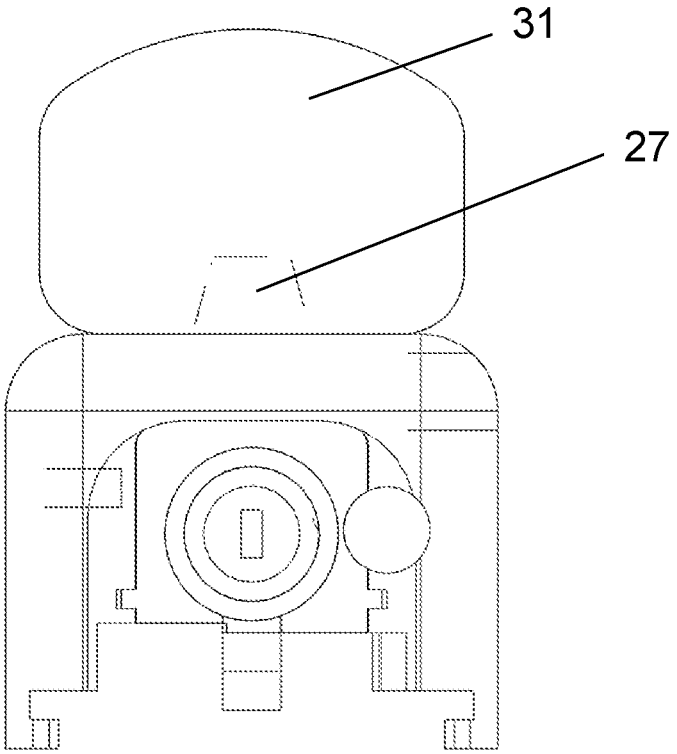
FIG. 5 is a front view of the slide of FIG. 2.

The slide 5 is of approximately square cross-section with a hollow interior, and encases cartridges (not shown) to be fired (FIGS. 2, 3 and 4). At the near end of the slide 5 (closest to the user when held ready to shoot) mounted on its upper surface 18, is an integrated reflector sight 17 formed of several components. In this embodiment, there are no front or rear iron sights present so that there is an unobstructed view across the sight 17. In other embodiments, the iron sights may still be provided.

The integrated sight 17 includes a red LED 19 encased in a cylindrical housing 21 mounted transversely across the slide 5. The position of the housing 21 is adjustable via rotation and/or lateral translation with respect to the slide 5. This provides an adjustment mechanism for the LED 19. The LED 19 is powered by a 3V lithium battery 23 fitted on the slide 5 adjacent the cylindrical housing 21. The battery 23 can be accessed and replaced from above, or on either side of the slide 5. In other embodiments it may be mounted on the rear of the slide.

Adjacent the battery 23 on the far side of the slide 5 is a reflector 25. The reflector 25 is an approximately wedge-shaped metal protrusion, formed together with the slide 5. It has a curved trapezium-shaped front surface 27 (i.e. a concave reflecting surface) which extends perpendicular to the upper surface 18 of the slide 5. Light from the LED 19 can reflect from the front surface 27 of the reflector 25 to the user's eye.

Surrounding the reflector 25 is a clear polymer lens 29, with an arched rectangular shape. The lens 29 is mounted via lugs (not shown) which cooperate with complementary shaped recesses (not shown) in the slide 5, in a locating and locking mechanism. The lens 29 has no frame, which reduces weight and complexity of the assembly, and provides a clear, unobstructed, view of the target. The lens 29 is removable by disengaging the lugs from the recesses, for example to replace the lens 29 with a different kind of lens.

When in position, the front surface 31 of the lens 29 provides a flush (i.e. substantially continuous) complete reflecting surface with the front surface 27 of the reflector 25. In this embodiment, the reflector front surface 27 contributes approximately 10% by area to the complete reflecting surface, the lens front surface 31 contributing the remaining 90%. The reflector front surface 27 is small relative to the size of the lens front surface 31 so that it does not obscure too much of the field of view. The lens 29 provides a protective bumper around the reflector 25, so that in the event that the handgun 1 is dropped, the reflector 25 would not be damaged.

The red LED 19 is positioned at the focal point of the lens 29 and reflector 25, so as to provide an infinity image of a red-dot superimposed on the field of view.

In a normal operating scenario, with the lens 29 in place and intact, light from the LED 19 is directed onto the complete reflecting surface, and reflects from both the lens front surface 31 the reflector front surface 27 to the user's eye. Since a red LED 19 is used, no red reflective filter is required on the lens 29, thus minimizing the visual signature. Additional circuitry controls the strength of the LED 19 output in response to the ambient light levels, giving optimal visibility of the red-dot against the target. If the lens 29 breaks or is otherwise damaged, the reflector continues to provide an infinity image of the red-dot.

In the first example embodiment of the invention, the components of the integrated sight 17 are inset in the slide 5 so that no part protrudes above the top surface 18 of the slide 5, except for the lens 29 and reflector 25, thus providing an unobstructed view across the sight 17.

Figure 6:
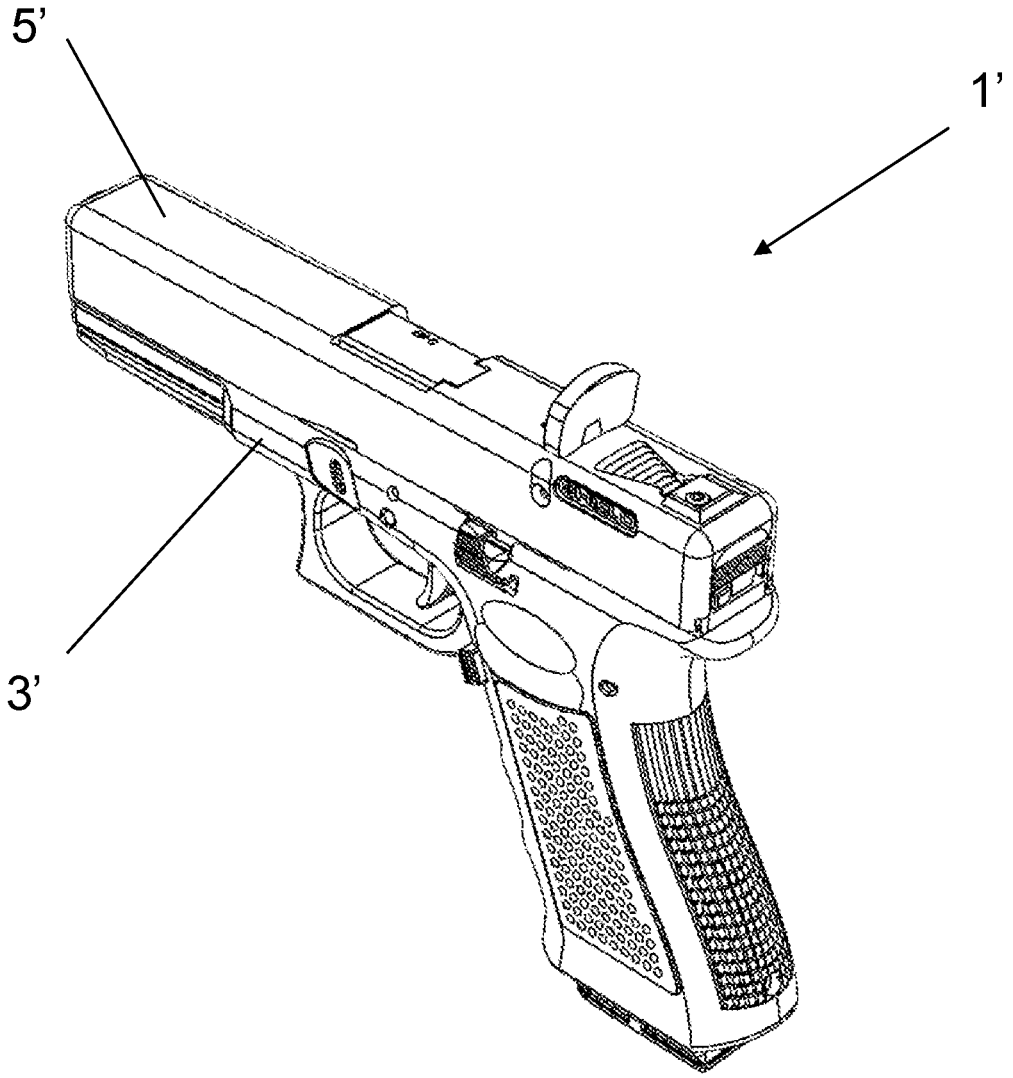
FIG. 6 is a perspective view of a handgun according to a second example embodiment of the invention.
Figure 7:
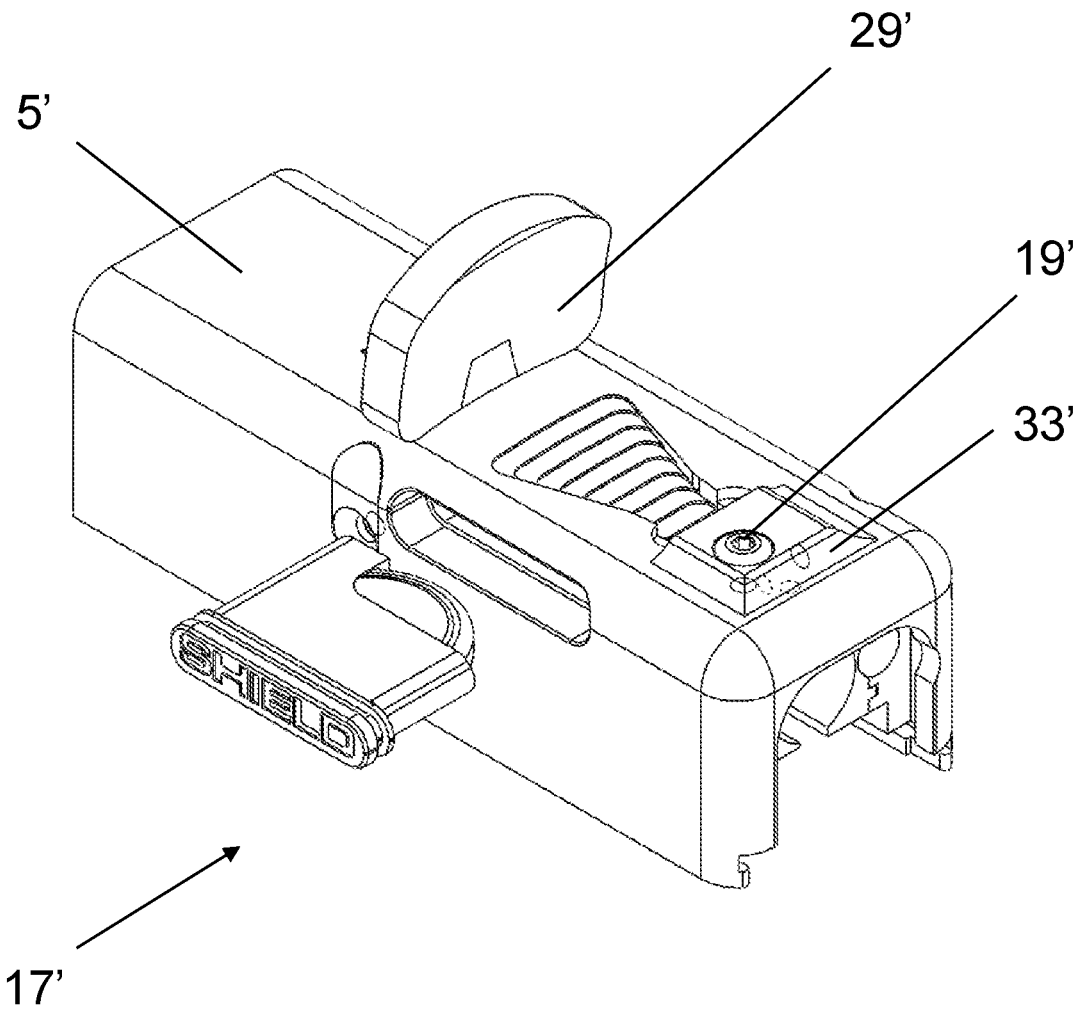
FIG. 7 is a perspective view of part of the slide of the handgun of FIG. 6 (with battery removed)
Figure 8:
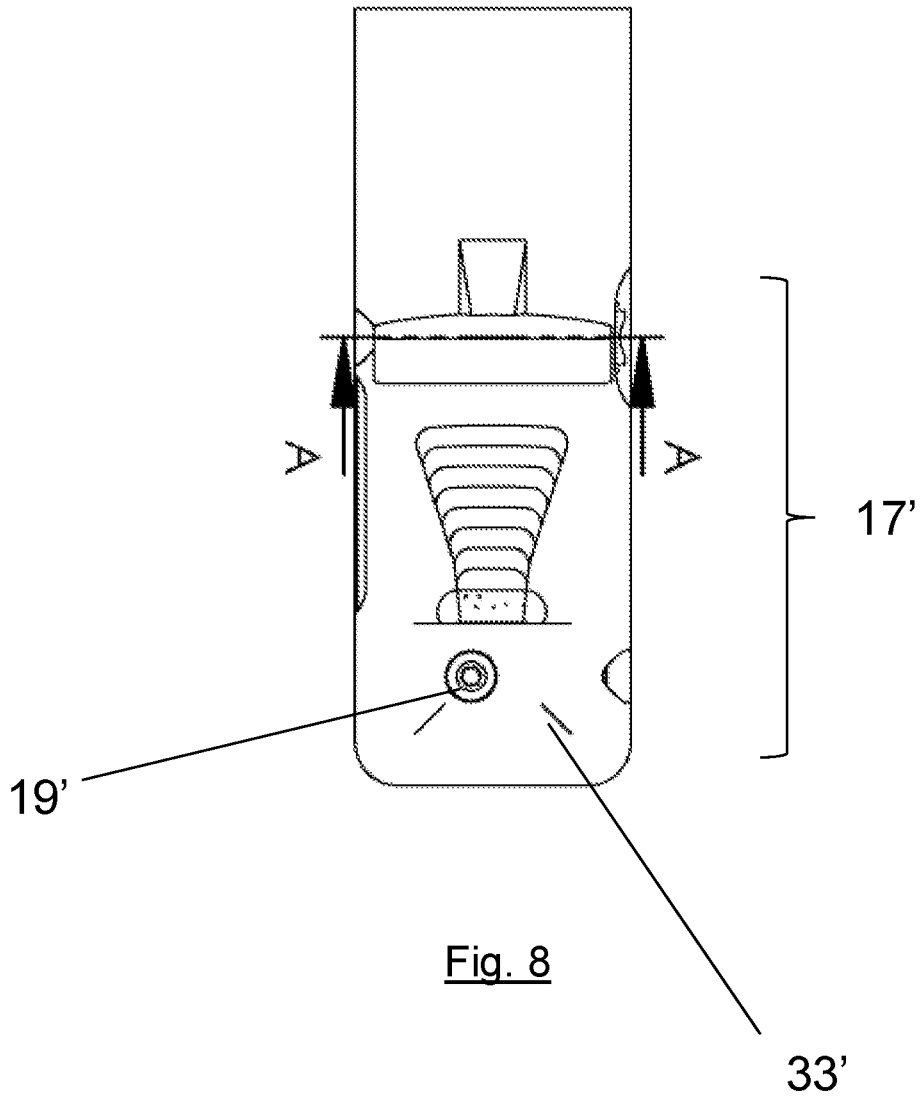
FIG. 8 is a top view of the part of the slide of FIG. 7.
Figure 9:
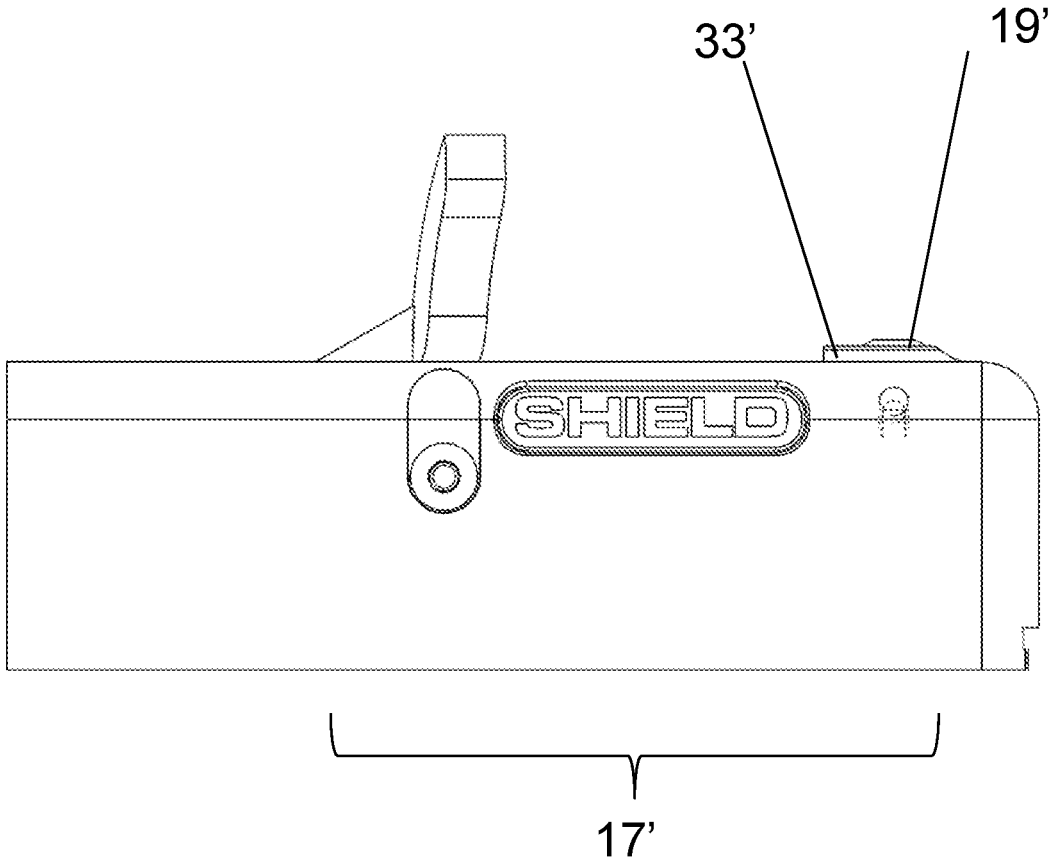
FIG. 9 is a side view of the part of the slide of FIG. 7.
Figure 10:
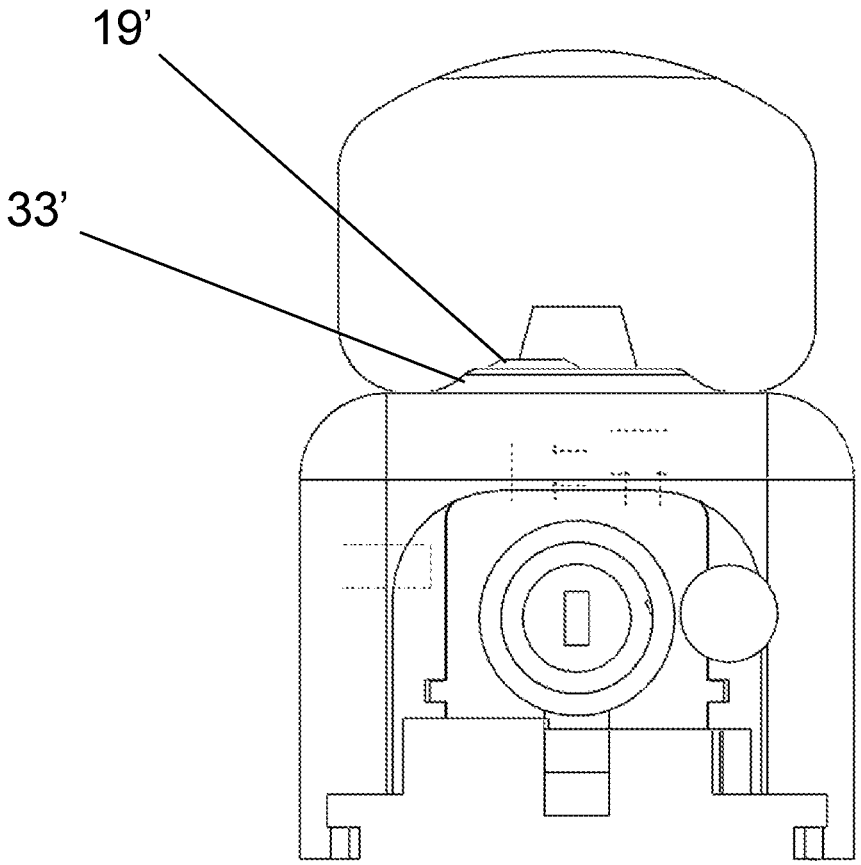
FIG. 10 is a front view of the part of the slide of FIG. 7.

In the second example embodiment of the invention, a handgun 1' includes a handgun body 3', and a spring-actuated slide 5' mounted for linear movement across the top of the handgun body 3' (FIG. 6). Parts which are substantially identical to corresponding parts of the handgun of the first example embodiment are indicated with like reference numerals.

The handgun 1' of the second example embodiment of the invention differs from the handgun 1 of the first example embodiment of the invention in that the LED 19' is not encased in a cylindrical housing, but instead is mounted on a carrier (not shown) within an adjustment assembly 33' (FIGS. 7-10). The position of the carrier with respect to the slide 5' is adjustable via a barrel nut and screw thread arrangement in the adjustment assembly 33', to adjust the position of the red dot reticle in the field of view. A user can access the barrel nuts from the outside of the adjustment assembly 33'.

Figure 11:
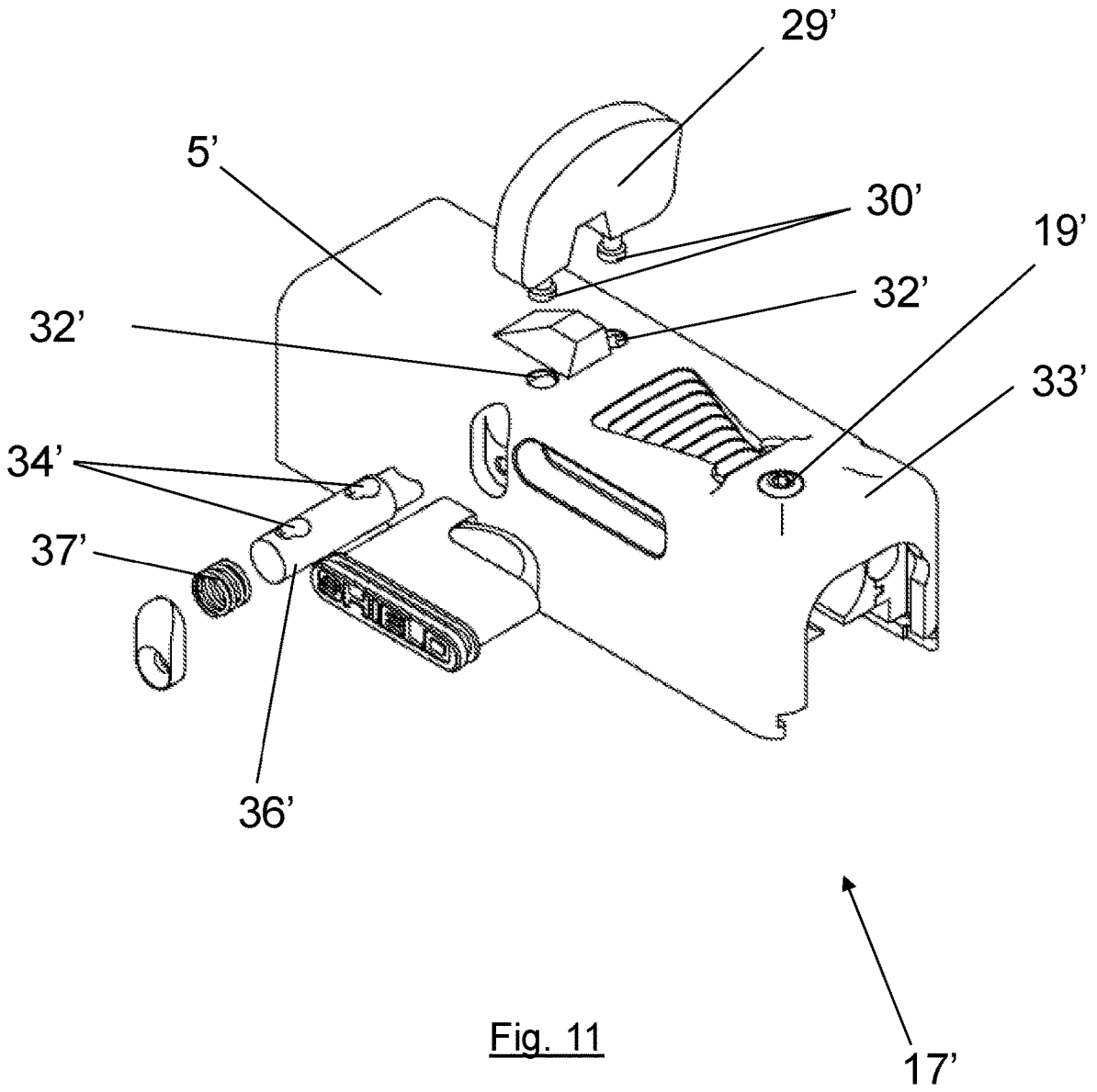
FIG. 11 is an exploded perspective view of the part of the slide of FIG. 7.
Figure 12:
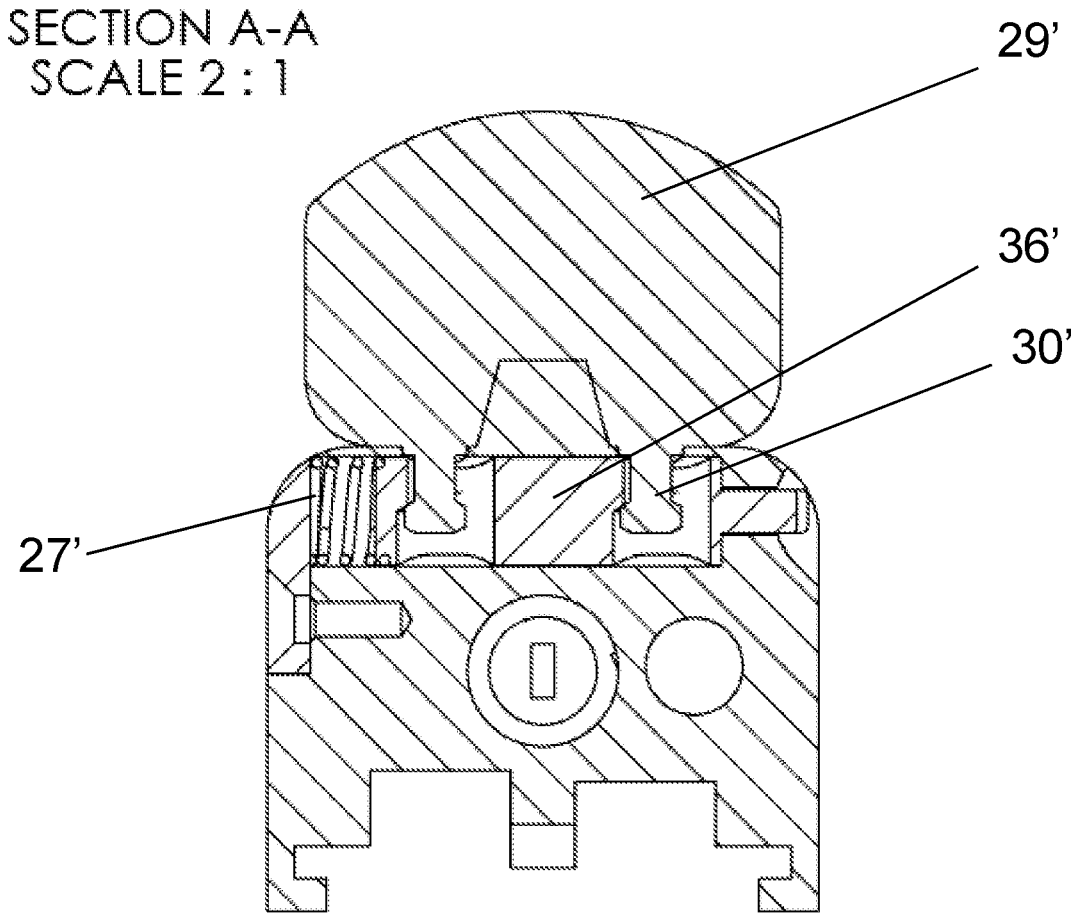
FIG. 12 is a section across A-A of FIG. 8, shown at a 2:1 scale.

The locating and locking mechanism for the lens 29' is the same as in the first example embodiment, and described in more detail herein (FIGS. 11-12). The lens 29' is movable from a disengaged to an engaged position. When disengaged from the slide 5', two lugs 30' extending from the lens 29' are visible. The lugs 30' each comprise a narrower part adjacent the lens 29' and a wider part further from the lens 29'. To locate the lens 29' in the slide 5', the user inserts the lugs 30' into two suitably shaped openings 32' in the top surface of the slide 5' (see FIG. 11). The lugs 30' are received in two complementary shaped holes, or recesses, 34' in a locating bolt 36' within a transverse channel in the slide 5'. The locating bolt 36' is biased to one side of the slide 5' by a coil spring 37'. Visible on the upper surface of the locating bolt 36' in FIG. 11 are the two holes 34', each shaped with a wider end distal from the coil spring 37' and a narrower end closer to the coil spring 37'.

Upon insertion of the lens 29', the force of the lugs 30' against the sides of the holes 34' causes the locating bolt 36' to move against the biasing force of the coil spring 37', to bring the wider ends of the holes 34' into line with the wider parts of the lugs 30', so that the lugs 30' can move into the holes 34'. As the lugs 30' move into the holes 34' the narrower parts of the lugs 30' are brought into line with the top surface of the locating bolt 36'. The locating bolt 36' can then move relative to the slide 5' and the lugs 30' under the biasing force of the coil spring 37' so that the narrower parts of the lugs 30' are retained in the narrower ends of the holes 34'. The lens 29' is then locked in place.

To remove the lens 29', similar steps are undertaken. As the lens 29' is pulled away from the upper surface of the slide 5', the force exerted on the sides of the holes 34' causes the locating bolt 36' (due to the angled inner surfaces of the holes 34') to move against the biasing force of the coil spring 37', relative to the slide 5' and lugs 30', so that the lens 29' can be disengaged from the holes 34'. As such the lens 29' can be replaced with a different lens. The lens 29' may be part of a set of interchangeable lenses.

Aside from the mechanism for the adjustment of the reticle, the integrated sight 17' of the second example embodiment of the invention functions in essentially the same way as the integrated sight 17 of the first example embodiment of the invention.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

In an alternative embodiment, the reflector 25 may not be integral with the slide 5, but may be fixed to the slide 5 with a screw, or glue or alternate fastening means. In an alternative embodiment the lens 29 may not be unframed but may have a shroud, or other surround. In an alternative embodiment, the lens 29 may be fixed to the slide 5 by alternative fixing means (i.e. instead of a lug and recess arrangement).

In another embodiment (not shown), the adjustment mechanism for the red-dot may have an alternative design. For example, the adjustment mechanism may be such that there is a small protrusion above the top surface of the slide to accommodate the adjustment mechanism.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

What is claimed is:

1. A handgun for aiming at a target, the handgun comprising:

a handgun body;

a slide arranged to move with respect to the handgun body;

a lens removably and directly mounted on the slide; and a light source associated with the slide and positioned at a focal point of the lens, such that when a user aims the handgun at the target, light from the light source reflects from the lens to a user's eye, providing an infinity image of an illuminated reticle over the target, wherein the lens is removable from both of the slide and the light source.

2. The handgun according to claim 1, further comprising:

a reflector associated with the slide, wherein the light source is positioned at the focal point of the reflector, and wherein the reflector is arranged to provide a continuous reflecting surface with the lens, such that when the user aims the handgun at the target, light from the light source reflects from the reflector and the lens to the user's eye, providing the infinity image of the illuminated reticle over the target.

3. The handgun according to claim 2, wherein the reflector is integrally formed with the slide.

4. The handgun according to claim 2, wherein the reflector comprises metal.

5. The handgun according to claim 2, wherein the lens surrounds a top and sides of the reflector in order to provide a protective bumper.

6. The handgun according to claim 2, wherein a height of the reflector is less than half a height of the lens.

7. The handgun according to claim 2, wherein a maximum width of the reflector is less than half a maximum width of the lens.

8. The handgun according to claim 1, wherein the slide comprises one or more lugs arranged to cooperate with one or more recesses in the slide to hold the lens in place.

9. The handgun according to claim 1, wherein the lens is frameless.

10. The handgun according to claim 1, wherein the light source comprises a red LED, and the illuminated reticle comprises a red-dot.

11. The handgun according to claim 1, wherein the light source is associated with a carrier in an adjustment assembly.

12. The handgun according to claim 1, further comprising a battery removably mounted on the slide.

13. A handgun, comprising:

a handgun body;

a slide arranged to move with respect to the handgun body;

a lens removably mounted on the slide;

a reflector protruding from the slide and surrounded by the lens, wherein the reflector is arranged to provide a continuous reflecting surface with the lens; and a red-dot generator integrated into the slide, the red-dot generator comprising a light source positioned at a common focal point of the lens and the reflector, such that when a user aims the handgun at a target, light from the light source of the red-dot generator reflects from the lens and the reflector to a user's eye, providing an infinity image of an illuminated dot over the target, wherein the lens is removable from the slide such that it can be replaced without removal of the reflector and/or the red-dot generator.

14. A handgun, comprising:

a handgun body;

a slide arranged to move with respect to the handgun body;

a reflector formed with and protruding from the slide; and a red-dot generator integrated into the slide, the red-dot generator comprising a light source positioned at a focal point of the reflector, such that when a user aims the handgun at the target, light from the light source of the red-dot generator reflects from the reflector to a user's eye, providing an infinity image of an illuminated reticle over the target.

* * * * *